US005207382A

United States Patent [19]

Simm et al.

[11] Patent Number: 5,207,382

[45] Date of Patent: May 4, 1993

[54] AUTOGENOUS FLAME SPRAYING APPARATUS FOR THE FLAME SPRAYING OF POWDER-FORM MATERIALS OR SPRAY POWDER

[75] Inventors: Wolfgang Simm, Ecublens; Hans-Theo Steine, Cugy; Peter Sommer, Prévérenges, all of Fed. Rep. of Germany

[73] Assignee: Eutectic Corporation, Flushing, N.Y.

[21] Appl. No.: 777,252

[22] PCT Filed: Jun. 5, 1990

[86] PCT No.: PCT/EP90/00885

§ 371 Date: Nov. 27, 1991

§ 102(e) Date: Nov. 27, 1991

[87] PCT Pub. No.: WO90/14895

PCT Pub. Date: Dec. 13, 1990

[30] Foreign Application Priority Data

Jun. 3, 1989 [DE] Fed. Rep. of Germany ... 8908954[U]

[51] Int. Cl.[5] ..... B05B 7/04; B05B 7/20

[52] U.S. Cl. ..... 239/79; 239/85; 239/132.5

[58] Field of Search ..... 239/79, 85, 132.5

[56] References Cited

U.S. PATENT DOCUMENTS

| | | | |
|---|---|---|---|
| 2,286,191 | 6/1942 | Aitchison et al. | 239/132.5 |
| 2,510,143 | 6/1950 | Sandora et al. | 239/79 |
| 2,544,259 | 3/1951 | Duccini et al. | 239/79 |
| 2,861,900 | 11/1958 | Smith et al. | 239/79 |
| 3,073,528 | 1/1963 | Wilson et al. | 239/79 |
| 3,085,750 | 4/1963 | Kenshol | 239/79 |
| 4,317,540 | 3/1982 | Simm et al. | 239/85 |

FOREIGN PATENT DOCUMENTS

| | | | |
|---|---|---|---|
| 8801203 | 2/1988 | World Int. Prop. O. | 239/79 |

*Primary Examiner*—Andres Kashnikow
*Assistant Examiner*—Lesley D. Morris
*Attorney, Agent, or Firm*—Bachman & LaPointe

[57] ABSTRACT

An autogenous flame spraying apparatus includes a supply line housing having gas supply lines for combustion gas, carrier gas and acceleration gas; a main housing connected to the supply line housing and having a supply line for a spray powder, and ducts communicating with the gas supply lines, the housing having a first injector for mixing the spray powder and the carrier gas to form a first mixture; an interchangeable nozzle carrier for carrying a releasable torch nozzle, the carrier being releasably attached to the main housing and having a second injector for mixing the combustion gas and the carrier gas to form a second mixture, the nozzle carrier also having ducts for conveying the first mixture and the second mixture to the torch nozzle, whereby the carrier can be replaced so as to alter both flame power and feed of spray powder.

30 Claims, 6 Drawing Sheets

A

AUTOGENOUS FLAME SPRAYING APPARATUS FOR THE FLAME SPRAYING OF POWDER-FORM MATERIALS OR SPRAY POWDER

BACKGROUND OF THE INVENTION

The invention relates to an autogenous flame spraying apparatus for the flame spraying of powder-form materials or spray powder.

Known flame spraying apparatuses of that kind, with injectors for mixing combustion gas and oxidation gas are designed for a given amount of combustion gas mixture, due to the structural configuration thereof, and are fairly complicated in terms of their design configuration. In particular the torch or burner body in the known constructions can only be manufactured with a great deal of difficulty with the desired degree of accuracy in regard to the components which are critical from the point of view of the torch function. Hitherto it has not been possible to increase the degree of structural accuracy and to achieve adaptability of individual components for an extended range of use in respect of the melting point of the various materials in powder form.

In consideration of those aspects the inventor set himself the aim of providing a flame spraying apparatus which is considerably simplified in regard to the structure of its torch body, while permitting inexpensive manufacture with a high degree of accuracy. In addition the invention seeks to provide that the flame spraying apparatus according to the invention covers a wide range of possible uses, that is to say, it can be adapted to a very wide range of spray materials and modes of use.

SUMMARY OF THE INVENTION

That object is attained by an autogenous flame spraying apparatus for the flame spraying of powder-form materials or spray powder by means of a torch or burner nozzle associated with supply lines for the spray powder and for combustion gas, oxidation gas and acceleration gas or mixtures thereof, on a torch body comprising at least two interchangeable main portions, on one of which are provided a nozzle carrier for the releasable torch nozzle and a connection for a powder feed and ducts for the spray powder and carrier gas, wherein the interchangeable nozzle carrier has at least one injector for mixing of the combustion gas and the oxidation gas and ducts for the feed of the gas mixture and a mixture of spray powder/carrier gas to the torch nozzle, whereas provided on/in the other main portion of the torch body are connections for the supply of the combustion gas, oxidation gas and acceleration gas. In addition, regulating valves for the ducts for combustion gas, oxidation gas and acceleration gas are to be associated with said further main portion - that being either outside the actual main portion or however integrated into ducts thereof.

For that purpose, it has been found desirable to provide a separation plane in respect of the torch body, at which 0-rings are provided for gas sealing purposes at the transition between the two main portions of the torch body.

A further separation plane permits fitment of the nozzle carrier to the torch body, while at least one plug element which engages into said body for the non-rotatably fixed nozzle carrier passes through the separation plane.

Moreover the main portions of the torch body are advantageously connected by a holding or clamping means, by means of which interposed sealing elements can be clamped in position.

It has been found advantageous for the described separation planes to be disposed substantially perpendicularly to each other, but in certain constructions they may also be disposed in mutually opposite relationship.

In regard to further features, attention is directed to the claims.

Such a design configuration for the flame spraying apparatus makes it possible for the torch body to be made up on the one hand from a portion which can be produced by machining and in particular by boring of a workpiece of bar material and the degree of accuracy of which is therefore readily sufficient, and on the other hand from a portion which only has the supply and possibly regulating means for the various gases required. In addition it is possible to arrive at a completely modular configuration in respect of the entire flame spraying apparatus and therewith a hitherto unattained range of use with all the advantages resulting therefrom in terms of manufacture, use, operational organization, repair and maintenance and the like.

The connection planes which are provided on the central portion permit the fitment of components which can be easily interchangeable by hand—nozzle carrier, powder feed adaptor or the like—and the opening of an axial powder duct makes it possible to use a carrier gas injector when employing internal conveying and to use the connection for the carrier gas-powder mixture when using external conveying.

The carrier gas injector which can be screwed into position, for sucking the powder out of the powder container which is fitted on to the powder feed adaptor may be provided with a laser-bored synthetic ruby for the injector bore, in order to maintain the degree of accuracy of the amount of powder supplied.

By virtue of the described sides and surfaces of the central portion, it is possible quickly and easily to alter not only the nature of the powder supply but also the power of the flame of the flame spraying apparatus by interchange of the nozzle carrier which includes one or more injectors for the combustion gas/oxidation mixture and the torch nozzle.

The construction of the central portion also provides that, by replacement of the nozzle carrier, the powder supply adaptor and the carrier gas injector or the external powder supply duct, the structure of the flame spraying apparatus can be so adapted that the entire range of use for autogenous flame spraying in terms of flame power, flame velocity and amount of powder can be covered with only one apparatus.

Arranged in the further main portion of the torch body, the feed line housing or valve block, are the connections for the feed of gases such as combustion gas, oxidation gas, carrier gas and acceleration gas, with the regulating valves and the quick-closure valve.

A feed line housing of such a configuration makes it possible—in a manner corresponding to the central portion—to adapt the torch body, by interchange, to the necessary conditions, providing it with one or more regulating valves, with or without quick-closure valve for the gases. The connections or supply lines for the gases may also be adapted as required by means of that procedure.

It will be appreciated that, by virtue of the configuration of the torch body, the combination of the composite apparatus may be modified to such an extent that it is possible to operate with the entire range of sprayable materials, from plastic material through metals or metal alloys with or without hard substances, metal oxides and refractory metals.

The scope of the invention therefore embraces a large number of embodiments of which in particular those described hereinafter are alternatively of significance:

The central portion or powder conveyor portion:

* has a removable attachment for receiving a powder container and an at least partially interchangeable mixing device for producing the spray powder-carrier mixture, which is connected to the powder container and to a carrier gas duct which in turn is connected to a gas duct of the gas conveyor portion;
* is connected to a feed means of an externally produced spray powder-carrier gas mixture;
* is connected to the nozzle carrier; and
* has gas ducts communicating with conveyor ducts of the supply line housing, for carrying the gases to the nozzle carrier, said gases being supplied to the gas conveyor portion.

The feed line housing or gas conveyor portion is:

** provided at least with conveyor ducts for combustion gas and oxidation gas or
** provided at least with a regulating valve for the combustion gas and with a quick-closure valve for the combustion gas and the oxidation gas, wherein the latter may also be operative for at least a further one of the gases being conveyed;
** connected to a means for the supply of an external carrier gas and has a corresponding conveyor duct;
** is connected to a means for the supply of an acceleration and/or cooling gas and includes a corresponding conveyor duct;
** is provided with at least one second regulating valve for at least a further one of the gases being conveyed, and
** is connected to the nozzle carrier and is provided with a conveyor duct for the spray powder-carrier gas mixture.

BRIEF DESCRIPTION OF THE DRAWINGS

Further advantages, features and details of the invention will be apparent from the following description of preferred embodiments and with reference to the drawing in which.

DESCRIPTION OF THE PREFERRED EMBODIMENTS

Figures 1, 2:
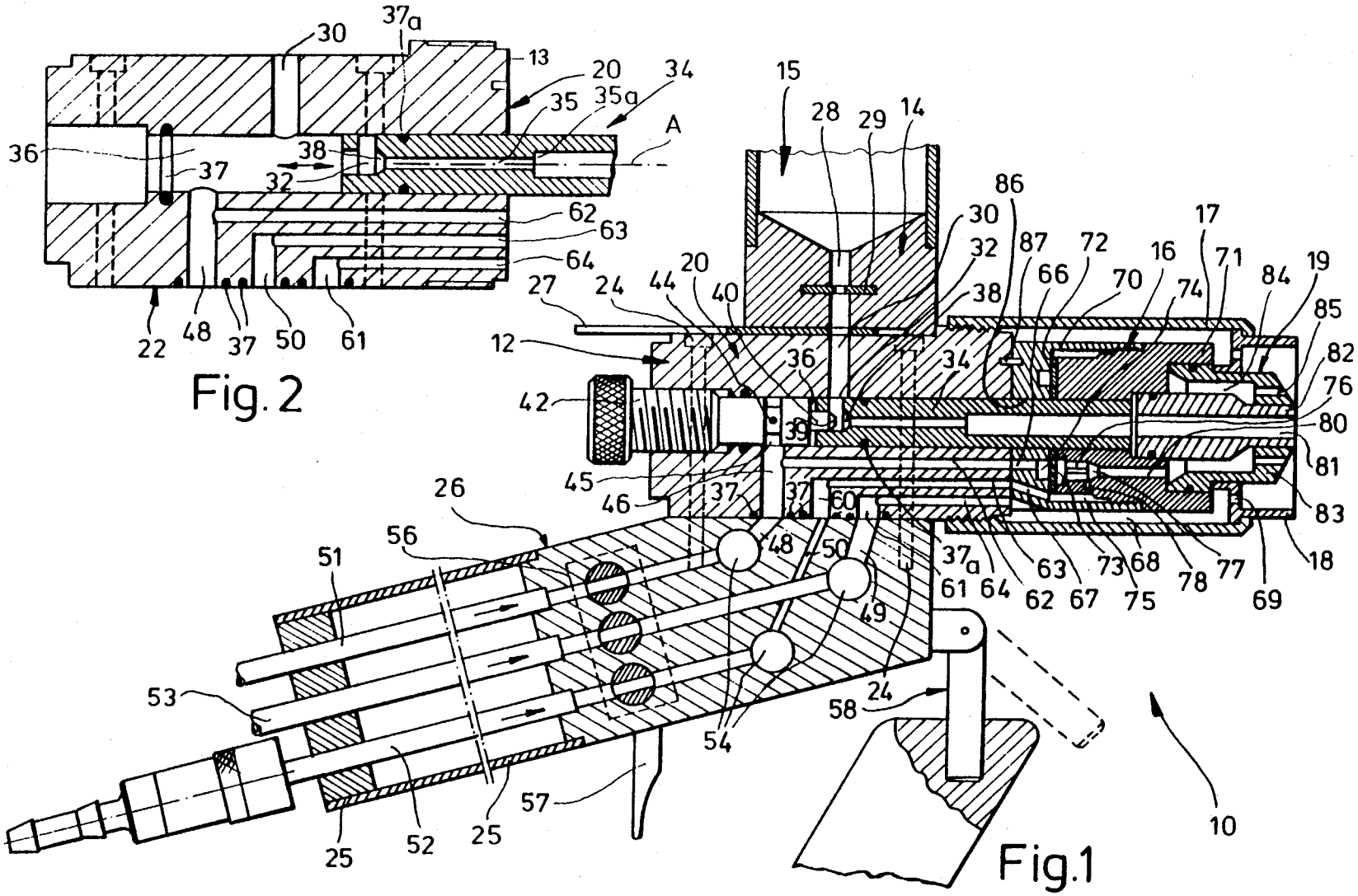
FIG. 1 is a view in longitudinal section through a flame spraying apparatus.
FIG. 2 is a view on an enlarged scale of a detail from FIG. 1.

Referring to FIG. 1, a flame spraying apparatus 10 comprises a burner or torch body 12 with feed attachment 14 releasably fitted thereon for a powder container 15 and an also removable nozzle carrier 16. The latter is fitted to an ,end face 13 of the torch body 12 and is surrounded by a fixing cap tube 17 which is screwed on to the torch body 12 and which with its free end engages over a nozzle ring 18 of a burner or torch nozzle 19.

The feed attachment 14 and the nozzle carrier 16 are fitted to a parallelepipedic central portion 20 of the torch body 12; a feed line housing 26 of the torch body 12 is connected to the central portion 20 by screws 24 in the region of an attachment plane 22 which is in opposite relationship to the feed attachment 14.

A powder duct 28 which extends in FIG. 1 at a right angle to the longitudinal axis A of the central portion 20 in the feed attachment 14 has extending thereacross an aperture means 29 which is for example rotatable,and is aligned with a bore 30 in the central portion 20, with the interposition of a slider 27 as a shut-off means; the feed attachment 14 can be fitted into position and released only when the shut-off means 27 is closed.

The bore 30 of the central portion 20 connects to a mixing chamber 32 which is formed by a radial bore in a powder conveyor tube 34. The latter is fitted into an axial bore 36 in the central portion 20 and sealed in position therein with an O-ring $37_a$; further 0-rings in the flame spraying apparatus 10 are also indicated by 37.

Disposed in opposite relationship to an intake opening 38, towards the nozzle, in the space 35 in the powder conveyor tube 34, which space is enlarged at $35_a$ forming step, is an outlet opening 39 of an injector nozzle 40 which projects from a screw bolt or insert 42 which is fitted into the axial bore 36.

A transverse bore 44 extends in the screw bolt 42 from a bore (not visible in the drawing) in the shank of the screw bolt 42, and opens at its other end into a peripheral groove-45 in the screw bolt 42. The peripheral groove 45 is disposed in front of a radial bore 46 in the central portion 20, by way of which oxygen as a carrier gas can be supplied to the injector nozzle 40.

The feed of the oxidation or carrier gas (oxygen) to the bore 46 is effected by way of an inclined bore 48 and a conveyor duct 51 in the feed line housing 26 which also includes a conveyor duct 52 for combustion gas (acetylene) and a conveyor duct 53 for an acceleration and/or cooling gas (air), and in addition regulating and shut-off members 54 which can be operated for example by way of rotary knobs (not shown), in each of the conveyor ducts 51 through 53. Reference numeral 56 diagrammatically indicates a quick-closure valve by which the various gases can be rapidly shut off in the desired sequence by means of an operating lever 57.

Fixed to the feed line housing 26 is a tube portion 25 as a handle, which is disposed around the conveyor ducts 51 through 53; it is also possible to provide a handle portion of which part is illustrated at 58 and which can additionally be mounted in position, or a fixing device for connecting the flame spraying apparatus 10 to a machine.

The conveyor ducts 52, 53 are also extended beyond their shut-off members 54 in the form of inclined bores 49, 50 in the housing 26, which in turn open into radial blind bores 60, 61 in the central portion 20. 0-rings 37 are used for sealing purposes in the attachment fitment plane 22.

Gas ducts 62, 63, 64, which are arranged in parallel-axis relationship with each other, extend from the radial or blind bores 46, 60 and 61 respectively. The gas ducts 62, 63 and 64 and the radial or blind bores 46, 60, 61 are put into the section plane in the drawing for the sake of simplicity, but in practice they preferably extend in different planes.

The gas ducts 62, 63 go into flow bores 66, 67 in the nozzle carrier 16, whereas the outwardly disposed gas duct 64, opens into an annular space or chamber 68 between the nozzle carrier 16 and the fixing tube 17, the space or chamber 68 serving for cooling of the nozzle carrier 16.

The annular space or chamber 68 is communicated by way of openings 69 with the outside front of the nozzle ring 16. In operation of the flame spraying apparatus 10, the openings 69 produce an air sheathing which surrounds the outer part of the torch nozzle 19 and a gas flame which is present thereat.

The nozzle carrier 16 includes a connecting sleeve 70 with nozzle holding means 71 screwed therein. Arranged at a flat connecting surface between the components 70 and 71 is a sealing disc 72 which seals off two annular chambers 74, 75. The annular chamber 74 is in communication by way of a flow bore or bores 66 with the oxygen duct 62 and the annular chamber 75 is in communication by way of an inclined bore or bores 67 with the combustion gas duct 63. Disposed in the nozzle holding means 71 is a further injector nozzle 76 to which oxygen flows from the annular chamber 74 by way of an opening 73 in the sealing disc 72.

For the combustion gas feed, a radial bore 78 which extends from the annular chamber 75 opens into a mixing chamber 77 at the outlet of the injector nozzle 76. The drawing does not show that a plurality of, for example three, similar injector nozzles 76 are distributed on the nozzle holding means 71 in the peripheral direction, the gas mixture being supplied from the injector nozzles to the torch nozzle 19 through suitable communicating bores 80.

The cylindrical torch nozzle 19 is of a two-part construction in FIG. 1; an inner part 82 and an outer part 83 which is fixedly connected thereto are fitted into suitably central recesses in the nozzle carrier 16. They also define an annular mixing chamber 84. Communicating with the mixing chamber 84 are on the one hand the communicating bores 80 and on the other hand a plurality of nozzle outlet ducts 85.

The inner part 82 of the torch nozzle 19 has a central bore 81 for powder conveying purposes, which is communicated with the interior of the powder conveyor tube 34 which engages into an axial bore 86 in the nozzle carrier 16, the bore, 86 extending on the longitudinal axis A. The nozzle carrier 16 and the powder conveyor tube 34 together form a plug connection; a fixing pin 87 which is disposed in parallel relationship with the axis is inserted for radially fixing the position of the two components 16, 20 relative to each other.

Figures 3, 4, 4A:
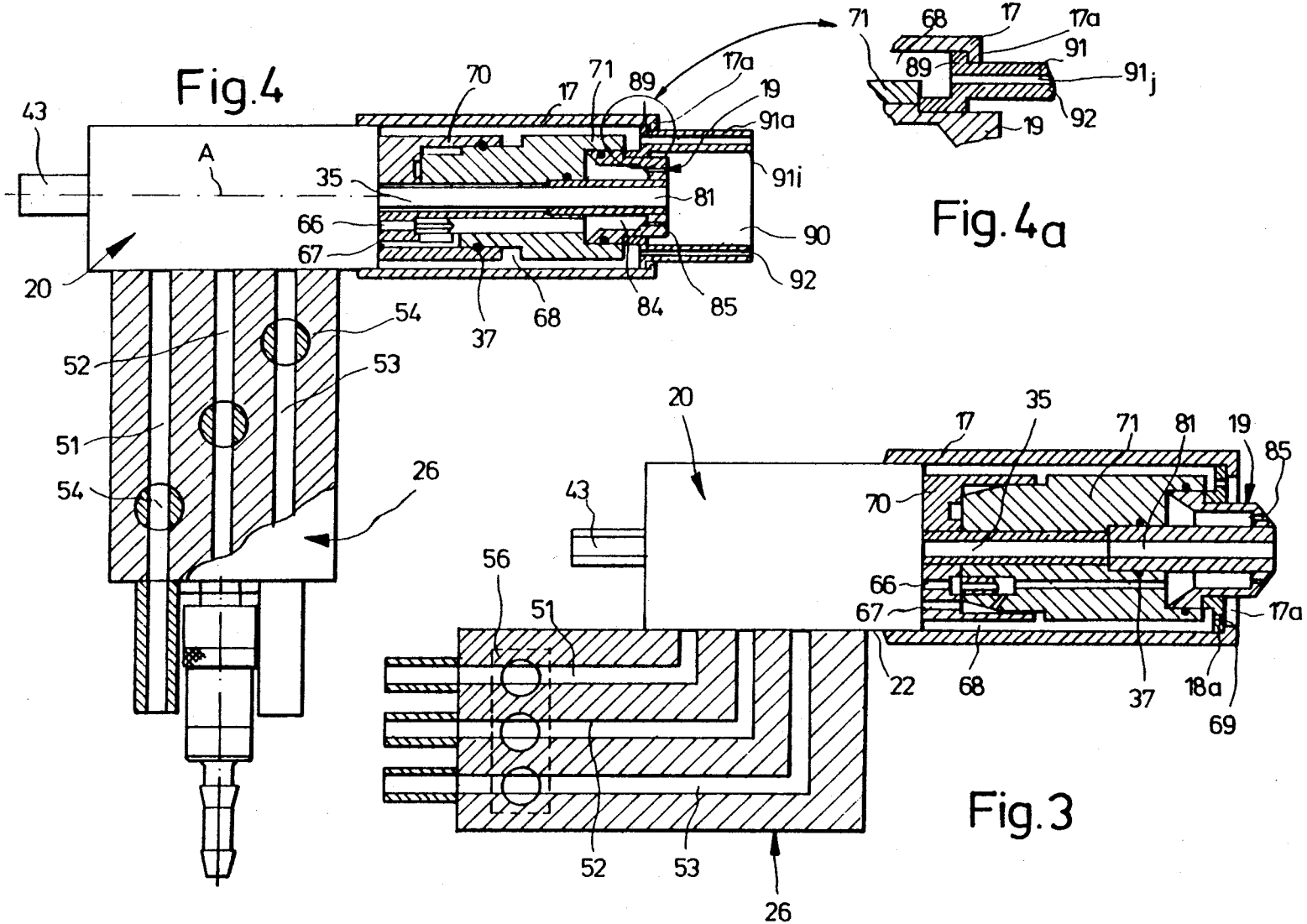
FIGS. 3 through 6 are partly sectional side views of further embodiments of a flame spraying apparatus.

In the embodiment shown in FIG. 3 the supply line housing 26 is parallel to the longitudinal axis A of the central portion 20 and the conveyor ducts 51 through 53 terminate at a right angle to the attachment plane 22. In this constructon, extending on the longitudinal axis A is a powder feed line 43 which is fitted into the axial bore, instead of the above-described screw bolt 42. Instead of the axially projecting nozzle ring, the torch nozzle 19 is surrounded by an insert ring $\mathbf{18}_a$ which contains the openings 69.

As shown in FIGS 4 and 4*a*, the supply line housing 26 may also be designed overall perpendicularly to the longitudinal axis A. In this construction the fixing cap tube 17 embraces with its radial collar $\mathbf{17}_a$ an acceleration tube 90 which is clampingly fixed with an annular collar 89 between the tube 17 and the torch nozzle 19 of the nozzle holding means 71. The acceleration tube is of a double-shell configuration, that is to say, two spaced-apart concentric tubes $\mathbf{91}_i$, $\mathbf{91}_a$ of different diameters define an annular chamber or space 92 which connects to the upstream-disposed annular space or chamber 68.

Figure 5:
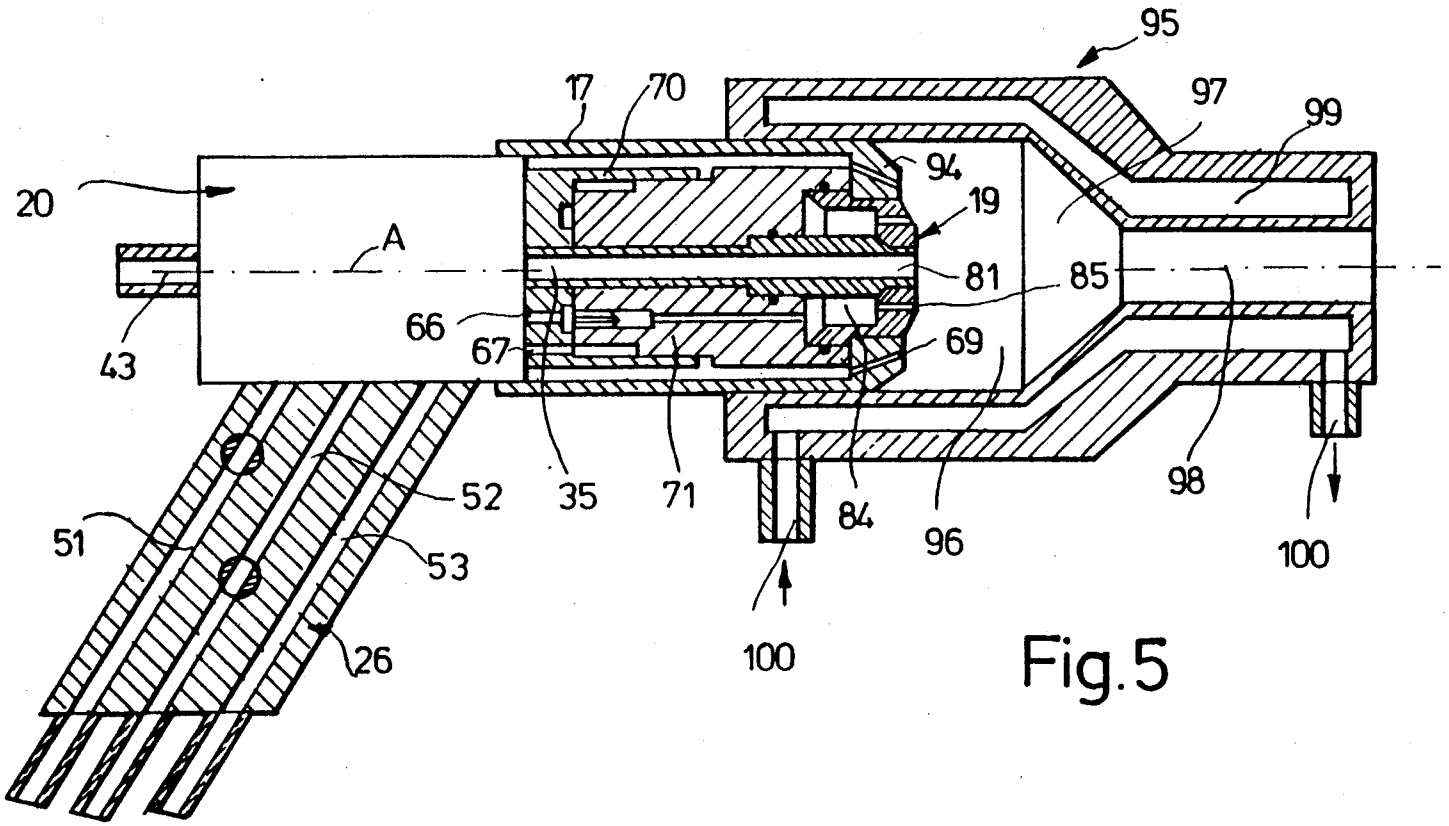

In FIG. 5, another acceleration tube 95 is carried on the fixing cap tube 17 which is provided with a pressure collar 94 containing the openings 69 which here are disposed inclinedly; the acceleration tube 95 can be axially pushed on to the tube 17. In front of the torch nozzle 19, the acceleration tube 95 forms a combustion chamber 96 which decreases in size in a region 97 to provide an axial duct 98. The tube interior 96 through 98 is surrounded by an annular space or chamber 99 which is integrated into the acceleration tube 95, as a cooling duct with feed and discharge connections 100.

Figure 6:
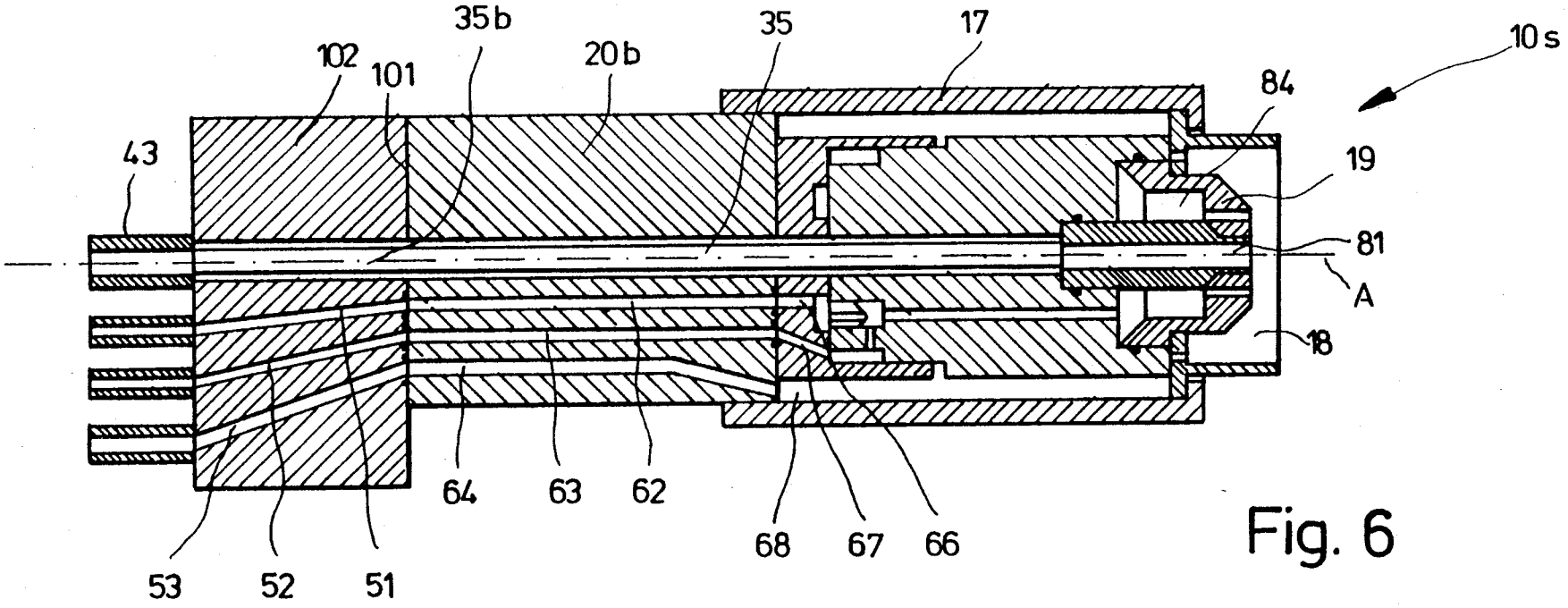

The flame spraying apparatus $\mathbf{10}_s$ in FIG. 6 also provides that the powder feed occurs axially at 43. In this embodiment, a housing attachment 102 is fitted to the rear face 101 of a central portion $\mathbf{20}_b$ with gas ducts 62 through 64 which extend in parallel relationship with the axis. An extension $\mathbf{35}_b$ of the space 35 in the tube passes through the housing attachment 102. The regulating or shut-off members are integrated in this embodiment in supply lines for the conveyor ducts 51 through 53 outside the flame spraying apparatus $\mathbf{10}_s$.

In FIG. 1 the spray powder is conveyed from above while in the other illustrated embodiments it is conveyed axially from the rear. In FIGS. 1 through 5 the carrier gas passes from below to the central portion 20 while in FIG. 6 it goes parallel to the powder feed. In constructions which are not shown, spray powder and carrier gas may be introduced parallel to each other from above or below.

Figure 7:
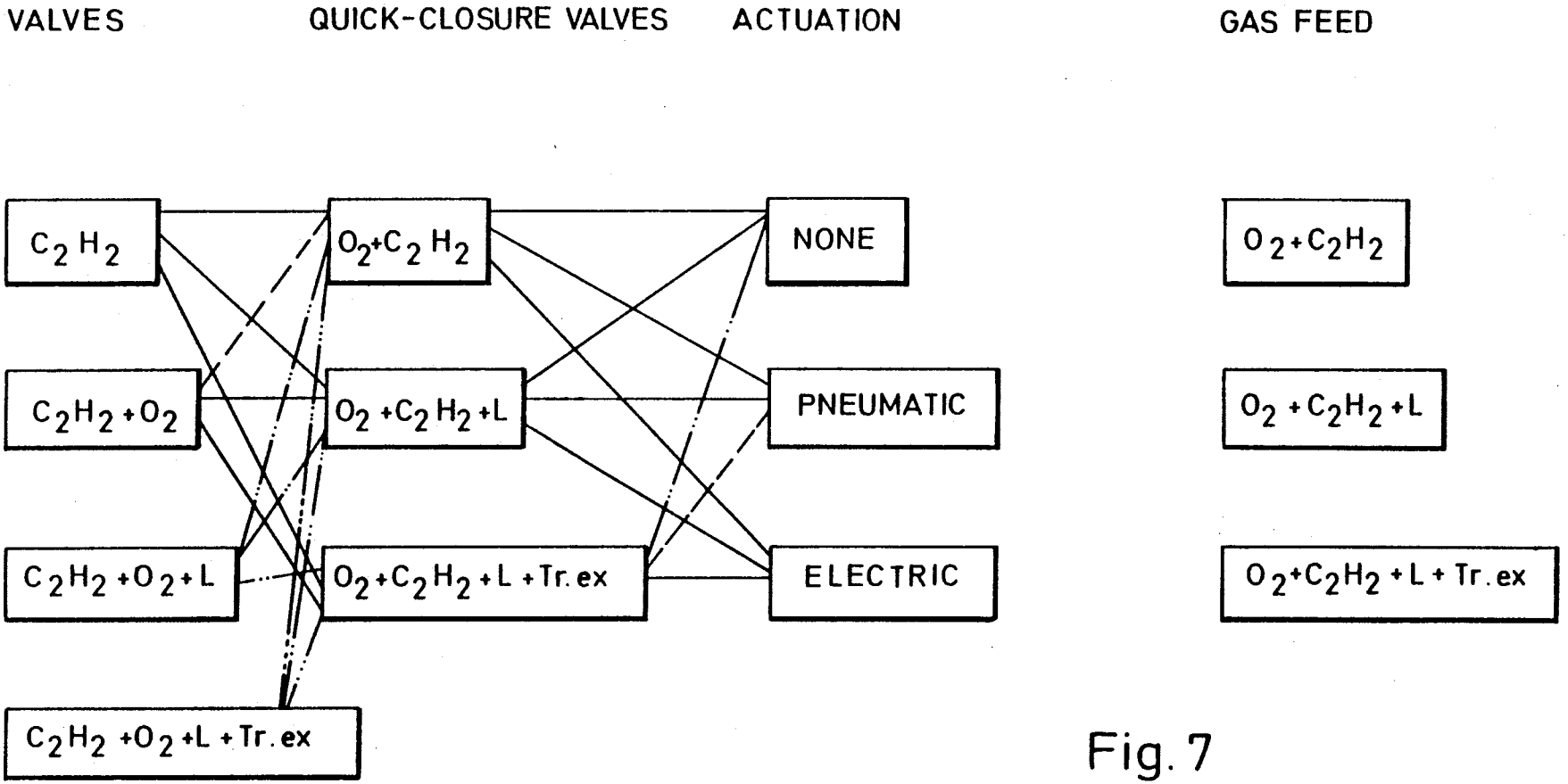
FIGS. 7 and 8 schematically depict the various modular configurations made possible by the apparatus of the present invention.
Figure 8:
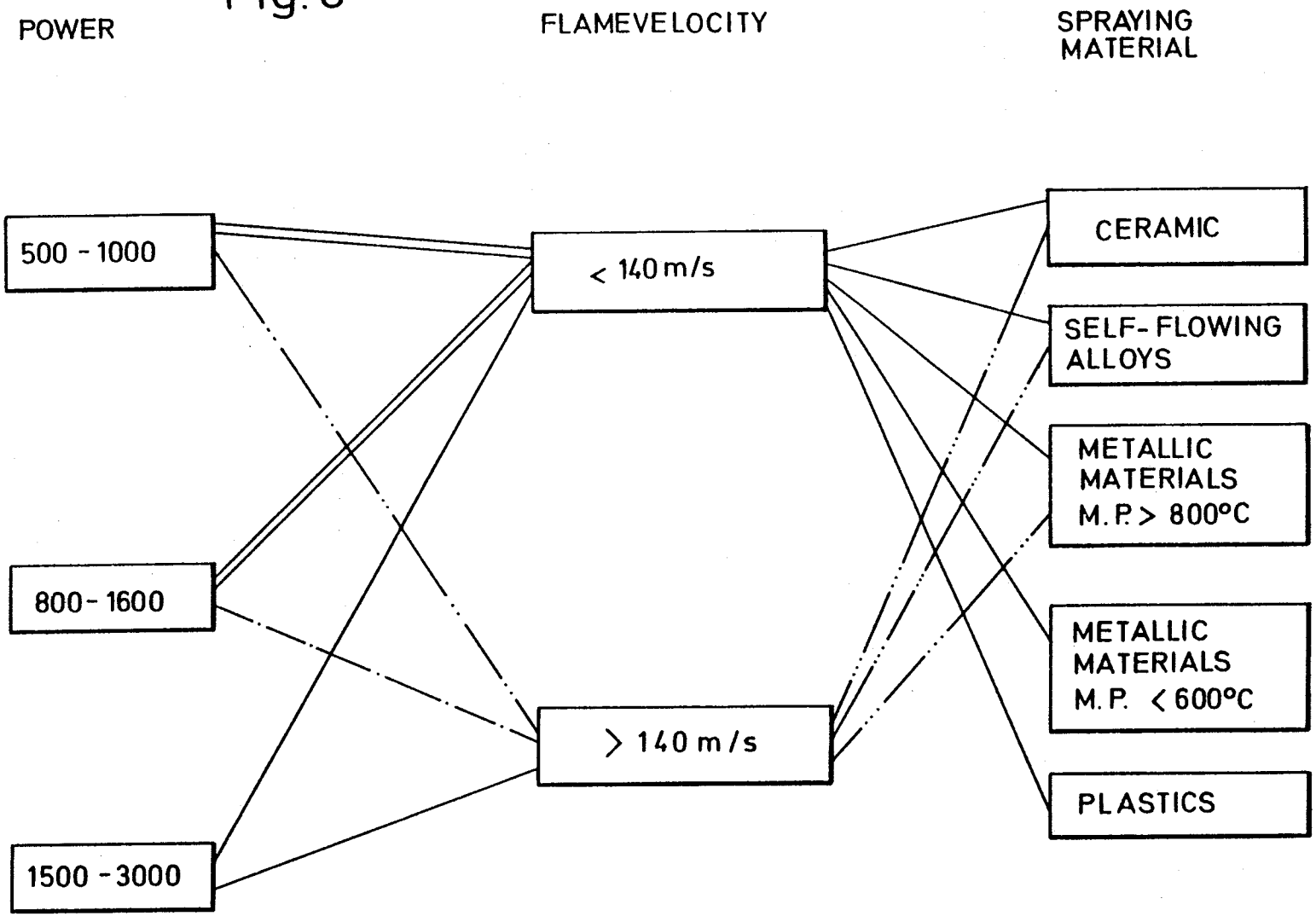

Use of the described central block 20, $\mathbf{20}_b$ admits for example of the following variations:

(a) on a burner or torch with internal powder feed (PF):

1) PF with $O_2$ of carrier gas internally,
2) PF with $O_2$ with external carrier gas;
3) PF with external carrier gas, (b) on a burner or torch with external powder feed (PF):

1) PF with external carrier gas
2) PF with external carrier gas and internal $O_2$,
3) PF with internal carrier-$O_2$, (c) on the burner or torch and the external powder conveyor:

1) refilling with gas return (see paragraph $b_3$ above),
2) pneumatic powder feed (see paragraphs $b_2$, $b_3$ above),
3) electronic control (see paragraphs $b_1$, $b_2$ above), The use of the supply line housing 26 permits for example the variations shown in FIG. 7 of the drawing, while the configuration of the nozzle carrier 16 permits possible uses as shown FIG. 8.

It will be seen generally from the foregoing that the torch or burner body 12 of the flame spraying apparatus 10, $\mathbf{10}_s$ forms the basis for a completely modular structure in respect of such an apparatus. Such arrangements preferably use simple plug connections with clamping screw means, which can be released and remade without special tools at the place of work, whereby adaptation to the respective situations of use and interchange for repair purposes is crucially facilitated.

The described division of the torch body 12 in a manner corresponding to the two functions of the powder feed or powder-carrier gas mixture on the one hand and the gas feed or regulation on the other hand can provide for a structural configuration by means of which it is possible to achieve a high degree of accuracy in respect of the various conveyor ducts in the powder conveyor portion, in a simple and inexpensive fashion.

On the other hand there is also an advantageous line of demarcation in terms of the operating categories of manual operation and automatic operation. The specific construction of the powder conveyor portion and the nozzle carrier/oxidation gas and combustion gas injector assembly further permits an extremely large number of combinations of the elements of the present modular apparatus, which does justice to any specific spray material and any situation of use in an ideal manner.

We claim:

1. An autogenous flame spraying apparatus, comprising:

a supply line housing having a combustion gas supply line, a carrier gas supply line and an acceleration gas supply line;

a main housing connected to said supply line housing and having a spray powder supply line and ducts communicating with said combustion gas supply line, said carrier gas supply line and said acceleration gas supply line, said housing having a first injector, communication with said spray powder supply line and said carrier gas supply line, for mixing said spray powder and a portion of said carrier gas to form a first mixture;

an interchangeable nozzle carrier for carrying a releasable torch nozzle, said nozzle carrier being releasably attached to said main housing and having a second injector, communicating with said combustion gas supply line and said carrier gas supply line, for mixing said combustion gas and a remainder of said carrier gas to form a second mixture, said nozzle carrier also having ducts for conveying said first mixture and said second mixture to said torch nozzle, whereby said nozzle carrier can be replaced so as to alter both flame power and feed of spray powder.

2. An apparatus according to claim 1, wherein said supply line housing and said main housing are connected at an attachment plane, O-rings being sealingly disposed at said attachment plane at a transition between said combustion gas supply line, said carrier gas supply line and said acceleration gas supply line of said supply line housing and said ducts of said main housing.

3. An apparatus according to claim 2, wherein said nozzle carrier is attached to said main housing at an end face of said main housing, a plug element engaging between said nozzle carrier and said main housing to provide non-rotatable mounting of said nozzle carrier.

4. An apparatus according to claim 3, wherein said end face of said main housing and said attachment plane between said main housing and said supply line housing are disposed in mutually opposite relationship.

5. An apparatus accordign to claim 1, further comprising a clamping means for connecting said main housing and said supply line housing, whereby sealing elements of said main housing and said supply line housing are clamped between said main housing and said supply line housing.

6. An apparatus accordign to claim 1, further comprising a regulating valve disposed in said supply line housing in said combustion gas supply line.

7. An apparatus according to claim 1, further comprising regulating valves disposed in said supply line housing in said combustion gas supply line and said acceleration gas supply line.

8. An apparatus accordign to claim 1, further comprising regulating valves disposed in said supply line housing in each of said combustion gas supply line, said carrier gas supply line and said acceleration gas supply line.

9. An apparatus according to claim 1, wherein said regulating valves are disposed outside of said main housing.

10. An apparatus accordign to claim 2, further comprising a feed attachment for said spray powder, disposed in opposite relationship to said attachment plane and being disposed upstream of and communicating with said first injector whereby said spray powder is drawn into said first injector.

11. An apparatus accordign to claim 10, further comprising a shut-off means for said spray powder, disposed at a connection plane between said feed attachment and said main housing.

12. An apparatus according to claim 11, further comprising an aperture means, disposed at said feed attachment, so as to regulate feed of said spray powder.

13. An apparatus according to claim 12 further comprising a powder feed tube extending transversely to said spray powder supply line of said main housing and communicating with a mixing chamber of said first injector.

14. An apparatus according to claim 13, further comprising an inset mounted in and closing a longitudinal bore of said main housing, said longitudinal bore communicating with said nozzle carrier, said first injector being disposed on said insert, said insert conveying said carrier gas from said main housing to said first injector.

15. An apparatus according to claim 14, wherein said first injector is adapted to be interchangeable for a feed tube for spray powder and said carrier gas from an external powder conveyor.

16. An apparatus accordign to claim 1, further comprising a powder feed line for feeding spray powder to said main housing, said powder feed line adjoining said main housing in an axial direction.

17. An apparatus accordign to claim 2, wherein said ducts of said main housing open through radial bores at said attachment plane, and said ducts of said main housing extend substantially parallel in said main housing.

18. An apparatus according to claim 17, wherein said powder feed line is connected to said main housing through a plug connection.

19. An apparatus according to claim 18, wherein said spray powder supply line projects out of said main housing and is connected to said torch nozzle.

20. An apparatus accordign to claim 19, wherein said torch nozzle is a multi-part torch nozzle having an inside nozzle part, said spray powder supply line being connected to said inside nozzle part.

21. An apparatus accordign to claim 20, wherein said multi-part torch nozzle further includes an outside nozzle part, said inside nozzle part and said outside nozzle part defining a mixing chamber therebetween, said mixing chamber having nozzle discharge ducts extending therefrom.

22. An apparatus accordign to claim 1, wherein said second injector is disposed in said nozzle carrier upstream of said torch nozzle.

23. An apparatus according to claim 1, wherein said nozzle carrier comprises a connecting sleeve and a nozzle holding means connected together at an abutment plane therebetween, said second injector being disposed at said abutment plane.

24. An apparatus accordign to claim 1, further comprising a sealing disk having a through opening, said disk being disposed upstream of sad second injector.

25. An apparatus accordign to claim 1, wherein a t least one annular chamber for combustion gas extends parallel to said second injector and communicates with a combustion gas duct of said ducts of said main housing so as to convey said combustion gas to said second injector.

26. An apparatus according to claim 25, wherein said at least one annular chamber is connected to a mixing chamber of said second injector through bores.

27. An apparatus accordign to claim 1, further comprising a fixing cap tube of releasably and gas-tightly bracing one of said nozzle carrier and said torch nozzle to said main housing.

28. An apparatus accordign to claim 27, wherein said fixing cap tube braces said torch nozzle through a nozzle ring disposed therebetween, an annular space being defined between said nozzle ring and said torch nozzle, and an additional annular space being defined between said fixing cap tube and said nozzle carrier, said annular space being connected to said additional annular space, said additional annular space also being connected to an accelerating gas duct of said ducts of said main housing.

29. An apparatus accordign to claim 28, further comprising an acceleration tube fitted on said fixing cap tube and having a combustion chamber which decreases in size in a flow direction of said torch nozzle.

30. An apparatus according to claim 29, wherein said acceleration tube further includes a cooling duct connected to an inlet for a cooling medium.

* * * * *